United States Patent [19]

Schlichthorst

[11] Patent Number: 4,586,908

[45] Date of Patent: May 6, 1986

[54] EXHAUST GAS SYSTEM FOR THE INTERNAL COMBUSTION ENGINES OF A SHIP

[75] Inventor: Norbert Schlichthorst, Beckdorf, Fed. Rep. of Germany

[73] Assignee: Blohm & Voss AG, Hamburg, Fed. Rep. of Germany

[21] Appl. No.: 621,508

[22] Filed: Jun. 18, 1984

[30] Foreign Application Priority Data

Jun. 16, 1983 [DE] Fed. Rep. of Germany ..... 3321782

[51] Int. Cl.[4] ..... B63H 21/14

[52] U.S. Cl. ..... 440/89

[58] Field of Search ..... 60/310; 440/1, 88, 89

[56] References Cited

U.S. PATENT DOCUMENTS

| | | | |
|---|---|---|---|
| 712,881 | 11/1902 | Wilson | 440/1 |
| 1,816,371 | 7/1931 | Hefti | 440/89 |
| 2,575,698 | 11/1951 | Wilson | 440/89 |
| 3,185,123 | 5/1965 | Schiffer | 440/88 |

FOREIGN PATENT DOCUMENTS

| | | | |
|---|---|---|---|
| 499412 | 3/1976 | U.S.S.R. | 440/89 |

*Primary Examiner*—Trygve M. Blix
*Assistant Examiner*—Edwin L. Swinehart
*Attorney, Agent, or Firm*—Nils H. Ljungman

[57] ABSTRACT

An exhaust gas system for a ship having at least one internal combustion engine for moving the ship through water, which exhaust gas system includes a first gas passage for conducting engine exhaust gases below the water surface and a second gas passage for conducting the engine exhaust gases above the water surface, and including a control valve responsive to the position of the ship in the water for determining the selection of the first gas passage or the second gas passage to conduct those exhaust gases, with a cooling member provided for the gases conducted by the first passage and having openings to the water for aspirating or passing the water through the cooling member when the ship moves through the water.

10 Claims, 8 Drawing Figures

9
7°
11
6
5
9
13
13
8
7
6
5
8
7
7°
9

EXHAUST GAS SYSTEM FOR THE INTERNAL COMBUSTION ENGINES OF A SHIP

FIELD OF THE INVENTION

This invention relates generally to exhaust systems for ships and more particularly to low noise and low thermal radiation exhaust systems therefor.

BACKGROUND OF THE INVENTION

It is known to provide an exhaust system for a diesel propulsion engine of a ship to remove the engine exhaust gases, which can then be expelled below the surface of the water. The exhaust gases of interest can be emitted by one or more internal combustion engines connected to a common muffler with the engines being mounted in a boat, such as a military water craft. It is desired to so design the exhaust gas system that there is obtained an optimum use of space, low sound radiation and low thermal radiation into the environment with consideration being taken into account that, in the event of damage or the occurrence of an exhaust leak, the exhaust gas system should remain operative for as long as the diesel engines are operative.

It is further desired that the system is so laid out that a separation of functions is observed using proven components.

Although, in the following description, only single channel exhaust systems are described, the present invention is applicable in relation to multi-engine collective exhaust systems.

SUMMARY OF THE INVENTION

An exhaust gas system is provided for the exhaust gases emitted by the internal combustion engines of a ship moving along a water surface and which exhaust gases are normally expelled below the surface of the water. The exhaust gas system includes a common muffler operative with a reversing flap for selectively conveying the exhaust gas to one of an emergency passage which discharges the gases above the water surface or to a main exhaust passage which discharges the gases below said water surface. The main passage includes an exhaust gas cooling device and a gas outlet, which without moving parts operates to aspirate or pass the water through said outlet as a result of the motion of the ship in relation to the water.

BRIEF DESCRIPTION OF THE DRAWINGS

FIG. 7 shows a perspective view of the curved tube provided witn elliptical openings exposed to the seawater;

DESCRIPTION OF THE PREFERRED EMBODIMENTS

The exhaust gas system here described is provided by way of example and can form part of a multiple engine, such as a four-engine, propulsion drive system with a plurality of additional diesel engine driven electric generators. Corresponding to the actual spatial layout and coordination in the ship, there can be two diesel engine-driven generators comprising an electrical generating plant and two propulsion drive engines housed in each one of two machine rooms. It is desired that one diesel engine driven generator and one propulsion drive diesel engine should be combined in relation to each exhaust pipe. However, it is within the scope of the present invention that additional engine components can be combined into a single exhaust gas system.

Figure 1:
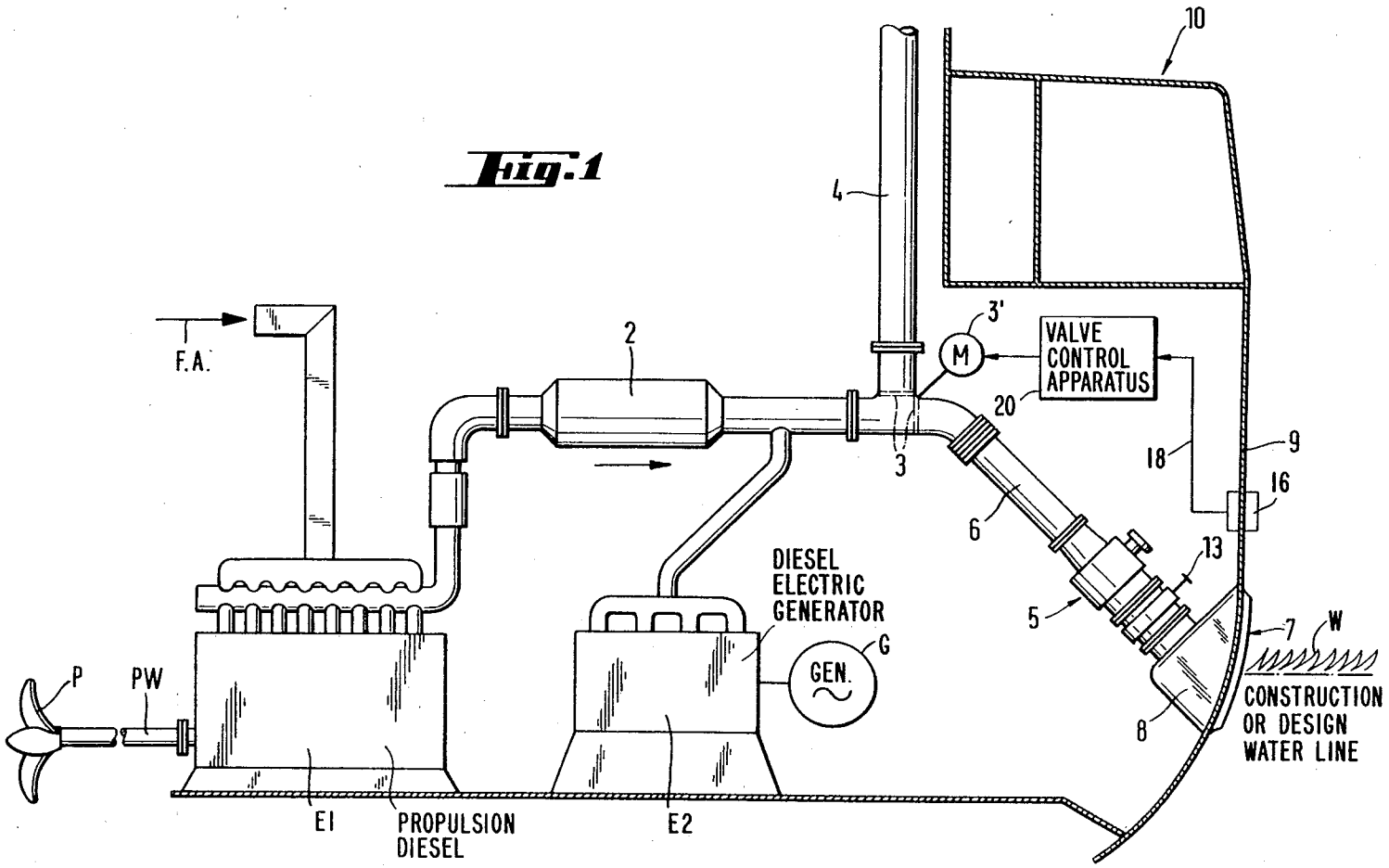
FIG. 1 shows schematically an internal combustion engine installation in a ship having an exhaust gas system in accordance with the present invention.

In FIG. 1 there is shown a propulsion diesel engine E1 and an electric generator diesel engine E2 coupled to an electric generator G with the hot exhaust gases produced by the engines E1 and E2 being passed in the direction indicated by the arrow through the common muffler 2, which absorbs the emitted noise according to a chosen absorption factor. Located downstream from the outlet of the muffler 2 is a reversing flap valve 3 that is controlled in position by a suitable control motor 3'. It is desired that this reversing flap valve 3 should, in the event of an emergency condition of the ship, be operative to conduct the exhaust gases out of the ship 10 through the emergency exhaust pipe 4 and provide a water-tight shut-off of a main exhaust pipe 6. This emergency operating condition can occur in the event of a water leak into the ship 10 when, due to the partial sinking of the ship, the normal water line, the design or construction water line, (CWL) is displaced appreciably upwards and the exhaust gas outlet 7 is then below the water surface W. It is necessary, in such a case, to close the main exhaust gas pipe 6 in order to eliminate the danger of internal flooding of the ship 10. The uncooled exhaust gases during such an emergency are then expelled into the atmosphere through the emergency exhaust outlet pipe 4.

A water line sensing device 16 is provided above the outlet 7, and if the ship 10 should be lowered for some reason into a position where the sensing device 16 goes below the water surface W, a control signal 18 is provided by the sensing device 16 to a valve control apparatus 20 for energizing the control motor 3' to operate the flap valve 3 such that the main exhaust pipe 6 is shut off water tight in relation to water entering the ship through the outlet 7 and the emergency exhaust outlet pipe 4 is thereby opened to conduct gases from the muffler 2.

The propulsion diesel engine E1 is coupled through a shaft PW to drive the ship propeller P. Fresh air is provided for the propulsion diesel engine E1 through the intake F.A.

Figure 2:
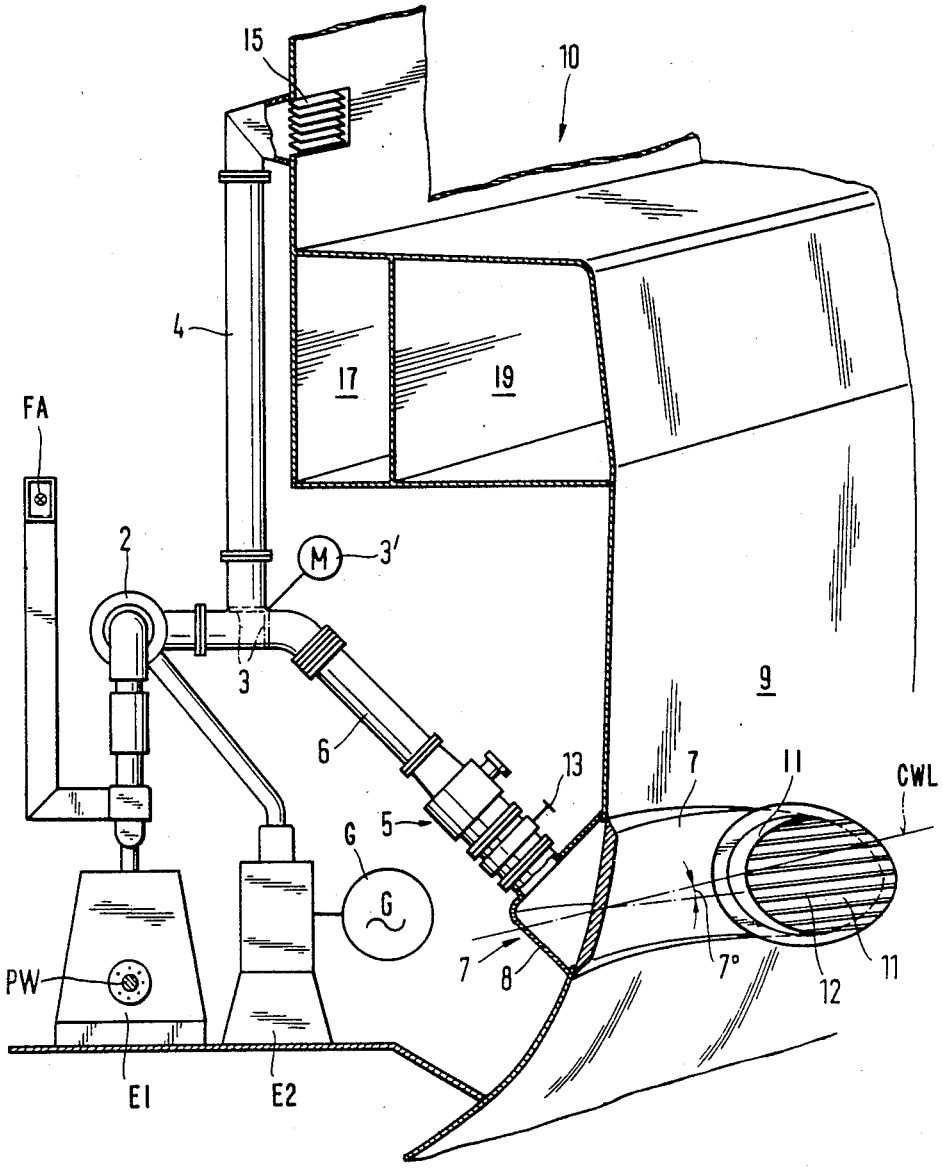
FIG. 2 shows in perspective the exhaust gas system of FIG. 1 with the exhaust gas outlet at the end of the main exhaust pipe and located at the water line.

In FIG. 2 there is shown a perspective drawing of the ship 10 having hull plating 9 and the exhaust gas system of FIG. 1 including the propulsion engine E1 and the engine E2 coupled with the electric generator G. The muffler 2 is connected through the flap valve 3 for conducting exhaust gases to the main exhaust pipe 6, the exhaust gas cooling device 5, and the exhaust gas outlet 7 including the curved tube 8 and the protective grid 12 over the exhaust gas opening 11. The emergency exhaust outlet pipe 4 leads to an opening 15 above the corridor 17 and the passenger or other cabin 19 of the ship 10.

Figures 3, 4:
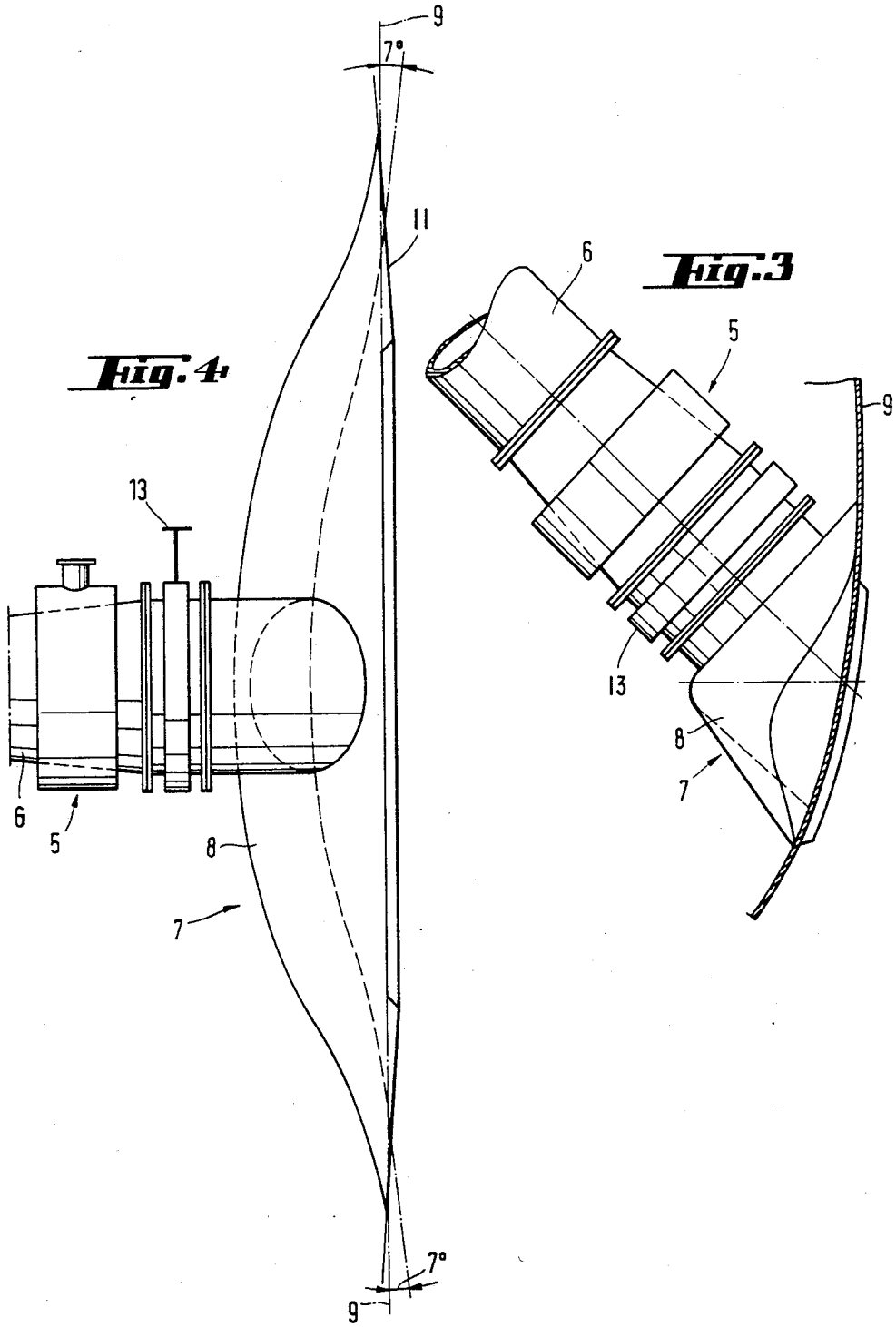
FIG. 3 shows one detailed view of the exhaust gas system of the present invention.
FIG. 4 shows a top view of the curved exhaust gas tube arrangement.

In FIG. 3 there is shown in greater detail the main exhaust pipe 6 for conducting exhaust gases away from the ship through the gas cooling device 5, the controlled slide valve 13 and the curve outlet tube 8.

In FIG. 4 there is shown a top view of the main exhaust gas pipe 6, the cooling device 5 and the curved outlet tube 8 having gas openings 11 and fastened to the hull plating 9 for conducting exhaust gases to the surrounding seawater in which the ship is positioned.

Figure 5:
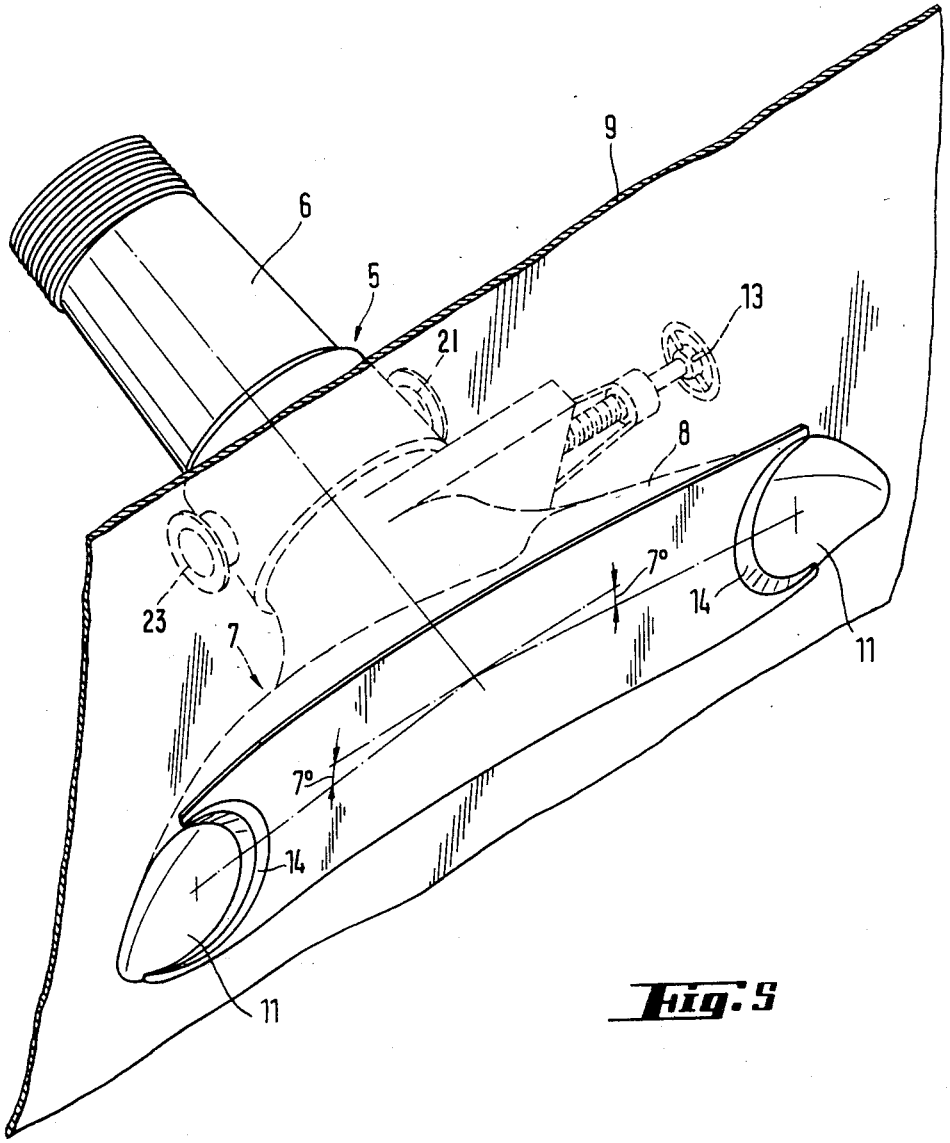
FIG. 5 shows a perspective view of the exhaust gas outlet including the elliptical openings.

In FIG. 5 there is shown a perspective view of the main exhaust pipe 6, the gas cooling device 5, the slide valve 13, the curved tube 8 having two gas outlet openings 11 operative with respective guide plates 14. The openings 11 are each positioned in respect to the plane of the hull 9 at an angle in the longitudinal direction of the ship 10 of about 3° to 7°.

Figures 1, 6:
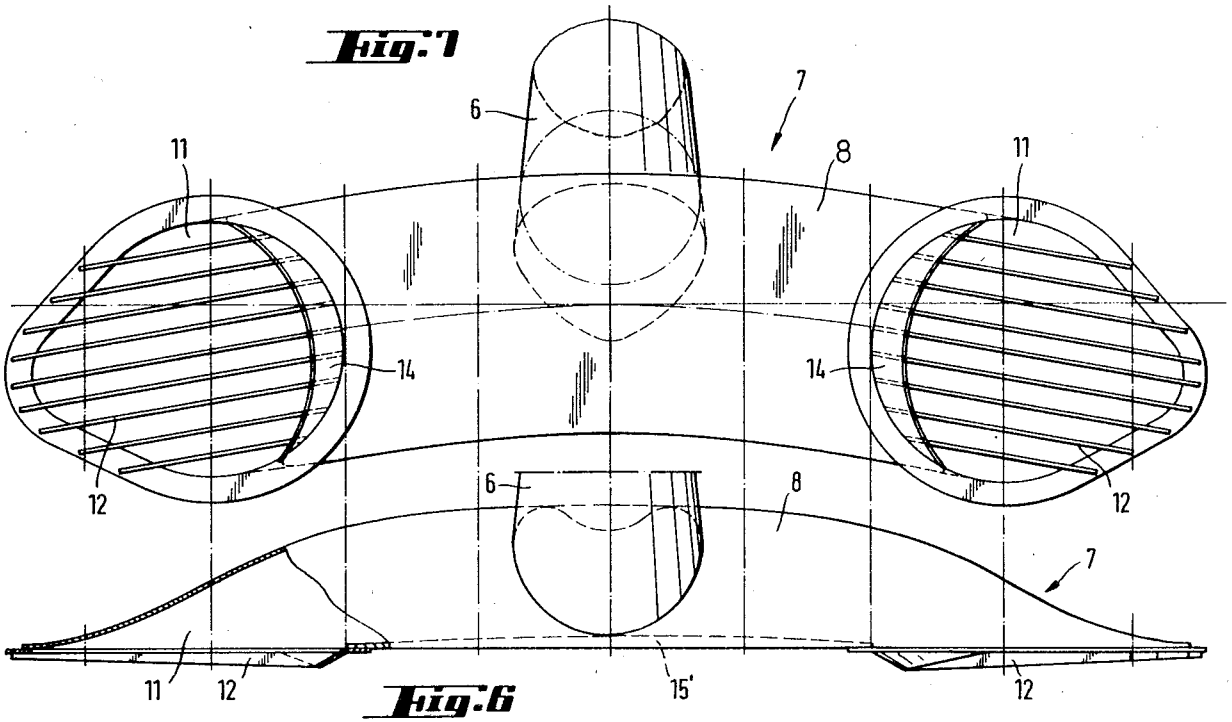
FIG. 6 shows a top view of the exhaust gas outlet including the hull reinforcement arrangement.

In FIG. 6 there is shown a top view of the exhaust gas outlet 7 including the curved tube 8 having exhaust gas openings 11 leading to the seawater. A hull plate section 15' covers and reinforces the curved tube 8 such that input seawater from one opening 11 toward the front of the ship 10 flows through the tube 8 to the other opening 11 toward the rear of the ship 10 and operates to cool the curved tube 8 in relation to heated exhaust gases, which are discharged, at least partially, below the surface of the water W, when the ship is moving in a forward direction through the seawater.

In FIG. 7 there is shown a perspective view of the main exhaust pipe 6 connected with the curved tube 8 having two spaced and elliptical shaped openings 11, each provided with a protective grid 12. A guide plate 14 is provided for each opening 11.

Figure 8:
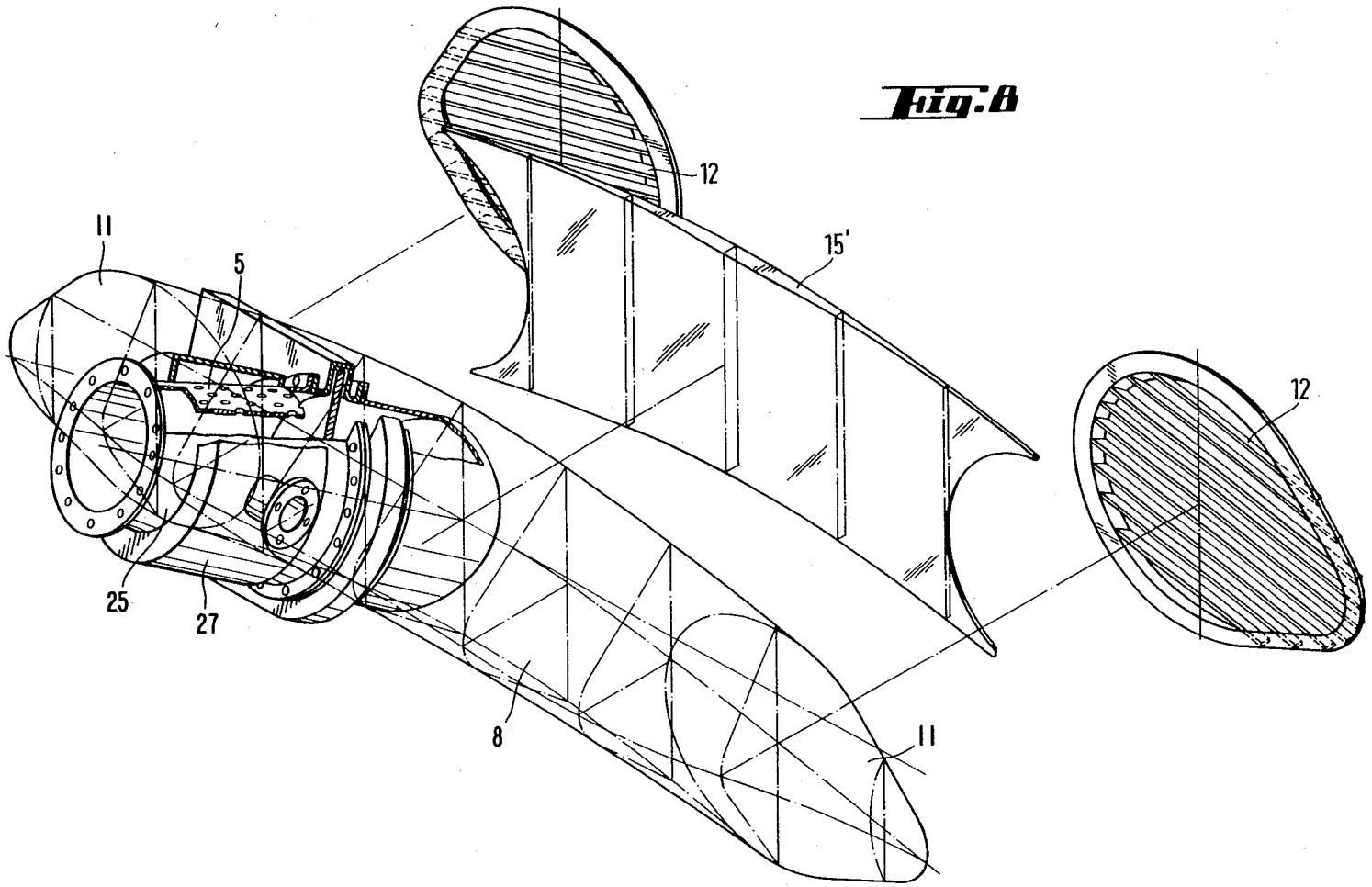
FIG. 8 shows an expanded view of the curved tube and exhaust gas openings from the ship.

In FIG. 8 there is shown an expanded view of the curved tube 8, the hull plate covering reinforcement 15', the elliptical openings 11 in the tube 8 and the protective grid 12 provided for each opening 11.

The cooling device 5 as shown in FIG. 5 is provided with a cooling water inlet 21 and a cooling water outlet 23 through which seawater can be pumped, by a suitable pump arrangement not shown, to cool the exhaust gases passing through the cooling device 5. In FIG. 8 there is shown the internal cylindrical member 25 of the cooling device 5 through which the exhaust gases pass and the external jacket 27 provided to contain the seawater pumped through the cooling device 5.

Normally and without an emergency operating condition of the ship 10, the main exhhust pipe 6 is open, through the action of the reversing flap valve 3, and the emergency exhaust outlet pipe 4 is thereby closed. The exhaust gases then are led downwards to about the surface level W of the water. The gases are fed through a cooling device 5 into the exhaust gas outlet and mixing tube 7 which is located in the hull plating 9 in the side of the ship 10 and which is supplied with the surrounding seawater via the respective water inlet and outlet openings 11. The hot exhaust gases (about 350°–500° C.) are cooled to about 80°–90° C. in the cooling device 5 by spraying-in cold seawater. The exhaust gases are then mixed in the exiting and mixing tube 7 with the surrounding seawater, as a result of which there is an additional reduction in temperature. It is important that the exiting or mixing tube 7 is made to operate reversibly, and that its center line lies approximately at the level of the normal water line CWL. For better operation, the tube 8 should have a curved shape, which may be substantilly kidney-shape, and the respective inlet and exit openings 11 should have a scoop contour as provided by the guide plates 14.

The outlet tube 7 is made symmetrical so that the same mode of operation is obtained both when the ship 10 is travelling forward and when traveling in a reverse direction. The tube 7 is mounted directly on the interior side of the hull 9 of the ship 10. The construction of the tube 7 in relation to geometrical dimensions, such as cross-section, length and curvature, is determined by the exhaust gas volume per hour, the exhaust gas temperature and the cooling water throughput, the immersion of the ship 10 as a function of load, the speed of the ship 10 and the desired exhaust gas exiting temperature.

In FIG. 8, the hull plate covering reinforcement 15' covers and reinforces the curved tube 8. The space between the curved tube 8 and the hull plate covering reinforcement 15' provides a double wall construction, through which water flows in operation for the purpose of cooling the hull plate covering reinforcement 15'.

The invention is not to be taken as limited to all the details that are described hereinabove, since modifications and variations thereof may be made without departing from the spirit or scope of the invention.

What is claimed is:

1. In an exhaust gas system including a muffler coupled to receive exhaust gases from at least one internal combustion engine carried by a ship moving upon a surface of a body of water, the combination of:

first gas passage means for conducting said exhaust gases, partially, below said surface of said water at least when said ship travels on a substantially calm body of water;

second gas passage means for conducting said exhaust gases above said surface of said water;

valve means responsive to the position of said ship, in relation to said surface of said water, for selecting one of said first and said second gas passage means for conducting said exhaust gases;

said valve means having means for holding said valve means in a position for conducting said exhaust gases through said first gas passage means except under emergency conditions of operation of said ship, said emergency conditions of operation including when said first gas passage means have been submerged under water to a predetermined depth;

first cooling means connected with said first gas passage means for cooling said exhaust gases conducted by said first gas passage means;

passing means, connected with said first cooling means, for passing said water from said body of water through said first cooling means when said ship moves through said water;

said first gas passage means having a portion adjacent to said water, said portion adjacent to said water having second cooling means for admitting said water adjacent thereto, said second cooling means for cooling said exhaust gas yet further;

substantially all parts of said second cooling means, for admitting said water into said first gas passage means, being stationary with respect to said ship; and said second cooling means, for admitting said water into said first gas passage means, having means for admitting said water adjacent thereto, both during a forward motion and a reverse motion of said ship, said means for admitting being disposed partially below said surface of said water, at least when said ship travels on a substantially calm body of water, whereby said admitted water cools said exhaust gases in said first gas passage means prior to conduction partially below said surface of said water, at least when said ship travels on a substantially calm body of water, without any moving parts.

2. The exhaust gas system of claim 1 for a ship having a hull including a longitudinal dimension, with said cooling means including a curved tube extending along said longitudinal dimension and having two ends respectively terminating in elliptically shaped openings, which openings lie in the plane of said hull.

3. The exhaust gas system of claim 2, with each of said openings having a face positioned at an angle of about 3° to 7° in relation to said longitudinal dimension of said hull.

4. The exhaust gas system of claim 2, wherein said tube has a substantially kidney-shaped cross section.

5. The exhaust gas system of claim 2, with each said opening being provided with a protective grid.

6. The exhaust gas system of claim 2, including water guide means operative with at least one of said openings for improving the passage of said water in relation to said cooling means.

7. The exhaust gas system of claim 2, wherein said tube includes a reinforcement member positioned between said openings and having a double-walled construction.

8. The exhaust gas system of claim 1, including a shut-off slide valve provided between said valve means and said cooling means.

9. In an exhaust gas system operative with a ship having a first position when normally moving along a water surface and having a second position lower than the first position, said ship having at least one internal combustion engine which generates exhaust gas, the combination of:

first means for conducting said exhaust gas, partially, below said water surface;

second means for conducting said exhaust gas above said water surface;

third means coupled with said at least one engine and including conduction control valve connected with each of said first means and said second means;

said third means having means for holding said valve in a position for conducting said exhaust gases through said first means except under emergency conditions of operation of said ship, said emergency conditions of operation including when said first means have been submerged under water to a predetermined depth;

fourth means responsive to the position of said ship in relation to said water surface and operative with said control valve of the third means for selecting said first means to conduct said exhaust gases when the ship is in said first position and for selecting said second means to conduct said exhaust gases when the ship is in said second position;

said first means comprising cooling means for admitting said water at said surface of said water adjacent to said ship into said first means, said cooling means for cooling said exhaust gas;

substantially all parts of said cooling means being stationary with respect to said ship; and said cooling means having means for admitting and passing therethrough said water at said surface adjacent to said ship, both during a forward motion and a reverse motion of said ship, said means for admitting being disposed partially below said surface of said water, at least when said ship travels on a substantially calm body of water, whereby said admitted water cools said exhaust gases in said cooling means prior to conduction partially below said surface of said water, at least when said ship travels on a substantially calm body of water.

10. The exhaust gas system of claim 9 wherein said first means includes means for cooling said exhaust gas and having at least two openings for passing water through said cooling means in response to movement of said ship moving along the water surface.

* * * * *